United States Patent [19]

Cameron et al.

[11] 4,072,383

[45] Feb. 7, 1978

[54] ELECTRICAL CONNECTOR INSERT RETENTION ASSEMBLY

[75] Inventors: John Keith Cameron, Hillside; Ronald Francis Krolak, North Riverside, both of Ill.

[73] Assignee: Bunker Ramo Corporation, Oak Brook, Ill.

[21] Appl. No.: 644,348

[22] Filed: Dec. 24, 1975

[51] Int. Cl.[2] ..... H01R 13/48

[52] U.S. Cl. ..... 339/59 R; 339/136 R; 339/176 R

[58] Field of Search ..... 339/59-63, 339/89, 90, 136, 176, 220

[56] References Cited

U.S. PATENT DOCUMENTS

| | | | |
|---|---|---|---|
| 2,563,712 | 8/1951 | Frei et al. | 339/89 M |
| 2,719,876 | 10/1955 | Hennessey, Jr. et al. | 339/89 R |
| 2,753,534 | 7/1956 | Sprigg | 339/59 M |
| 2,881,479 | 4/1959 | Quackenbush | 339/89 M |
| 2,963,536 | 12/1960 | Kokalas | 339/60 M |

FOREIGN PATENT DOCUMENTS

| | | | |
|---|---|---|---|
| 1,183,991 | 7/1959 | France | 339/89 M |

*Primary Examiner*—Joseph H. McGlynn
*Attorney, Agent, or Firm*—William Lohff; F. M. Arbuckle

[57] ABSTRACT

An electrical connector member including a hollow housing member with an internal restricted passageway, an adjacent outer radial shoulder and a reference surface axially spaced from the shoulder oppositely to the passageway; and an insert member snugly retained against axial movement in first and opposite axial directions by said shoulder and surface, the insert member including a restraining surface in abutment with said shoulder, the restraining surface being shaped by plastic deformation of the weakened peripheral surface portion on the insert member by the wall of the restricted passageway during the final stages of the positioning of the insert member. The insert member before deformation includes the weakened peripheral surface portion formed by a plurality of axially extending knurls, and an adjacent protective collar which protects the weakened portion from deformation until the collar has passed through the restricted passageway and the insert member is in the final stage of positioning.

31 Claims, 8 Drawing Figures

76
72
74
52
58
82
80
78

82
80
78
52
58

66
55
86
49
53

89
90
86
55
88
76
87
72
74
68
70

92
94

30'

ELECTRICAL CONNECTOR INSERT RETENTION ASSEMBLY

BACKGROUND OF THE INVENTION

In electrical connectors utilizing hollow shells and internal insert members carrying one or more electrical contact members, it has often been difficult to accurately locate the insert members in exact predetermined axial positions between and snugly against immovable stop surfaces of the shells particulary when the shells are of one-piece construction. Manufacture of insert members usually results in some variation in the axial dimension due to the effects of manufacturing tolerances. With the stop surfaces being spaced apart to accommodate an axial dimension greater than the lower limit of range of values for the axial dimension, a slight gap can occur between the insert member and one of the stop surfaces often permitting some movement of the insert member.

One solution to the problem has been to construct one of the stop surfaces on an adjustable member to accommodate insert members of differing axial dimensions. In some instances, one of the stop surfaces is provided on a separate shell member and axially moved to snugly engage the insert member. In other instances, a wave washer or other spring member provides an adjustable stop surface to accept insert members of varying axial dimension. Also as described in co-pending application Ser. No. 453,674, a tapered retaining ring is positioned against a tapered surface in the shell and includes a stop surface providing retention of the insert member. The axial position of the stop surface will vary depending on the portions of the tapering surfaces which meet in engagement and the axial dimension of the insert member.

The above described retention techniques utilizing adjustable stop surfaces on separate shell members or on separate retaining members add to the cost and complexity of electrical connectors. Therefore, it would be desirable to provide an electrical connector in which the insert member is retained between and snugly against immovable stop surfaces in which some variation in axial dimension in the insert member is permitted.

SUMMARY

Briefly, the invention is directed to an electrical connector member in which an insert or insert combination is axially dimensioned with a weakened periphery on an end portion to extend beyond an inner retaining shoulder in a hollow housing of the connector member, with the weakened portion being deformed to provide an insert shoulder at the position of the housing shoulder. By this technique, inserts selected from a group of inserts with an axial dimension varying within upper and lower limits can be snugly fitted between separated retaining shoulders axially spaced apart by a predetermined distance. The extension of the weakened portion of the insert beyond the predetermined distance provides a portion to be deformed at one of the shoulders to form the desired retention shoulder on the insert.

Another feature of the invention involves a housing with a restricted entry passageway leading to the mounting cavity for the insert and having an outer wall sized to compress and deform the weakened portion. A protective collar is provided on the insert axially disposed to the weakened portion to protect the weakened portion from deformation until the opposite end portion of the insert is snugly positioned against the opposite retention shoulder. Under these conditions, the protective collar is inwardly positioned beyond the passageway and a wall defining the passageway and usually adjoining one of the retention shoulders deforms the weakened portion.

Deformation of the weakened portion by radial compression advantageously provides surfaces for both axial and rotational retention of the insert. Another advantage is that an insert can be snugly fitted between inwardly opposite radial shoulders in a housing integrally formed by one-piece construction. Another advantage is that an insert or insert combination can be accurately positioned against a front reference surface with essentially no gap or axial movement permitted. A further advantage is that the positioning of structural features on the insert can be accurately positioned rearwardly on the connector member in an accurate predetermined axial dimension to the front surface.

DESCRIPTION OF THE PREFERRED EMBODIMENTS

For providing an insert retention system, the inventive connector comprises insert retaining means including a pair of surfaces separated by an axial distance within an electrical connector housing, plastic insert means elongated axially slightly beyond the axial distance of the insert retention means with a weakened portion on one end portion, and deforming means for deforming the weakened portion to provide a retention surface essentially at the axial distance. With the weakened portion extending to and slightly beyond the axial distance between the insert retaining means, retention surfaces can be provided in the insert means at essentially the axial distance to provide snug engagement between the insert and the insert retention means.

In one embodiment of the invention, the deforming means is provided by insert compression means which provides the desired deformation of the weakened portion at the final stage of insert mounting with the weakened portion being protected during the earlier stages of positioning by a protective collar axially disposed with respect to the weakened portion. During the final positioning or mounting of the insert means, the protective portion passes beyond the insert compression means which acts to form a retention surface in the weakened portion of the insert means. Advantageously, the insert is snugly retained both axially and rotationally by the retention and deforming means. The protective portion of the insert means preferably extends peripherally around the insert means with sufficient surface area to withstand a compressive force applied by the compression means without permanent deformation while the axially adjacent weakened portion is provided with a reduced peripheral surface area insufficient to withstand the same compressive force without permanent deformation. Preferably, the reduced surface area is provided by a plurality of separated high points arranged in groups and extending transversely to the axis of the insert means.

The invention is particularly useful with a connector housing having an inner cavity, opposed retention shoulders, and a restricted entry passageway integrally formed in one piece construction. In the mounting of the insert axially into the cavity, an adjacent wall of the passageway compressively deforms the weakened portion after the protective collar has passed into the cavity and forms a retention surface on the insert at the desired position within the housing.

Figure 1:
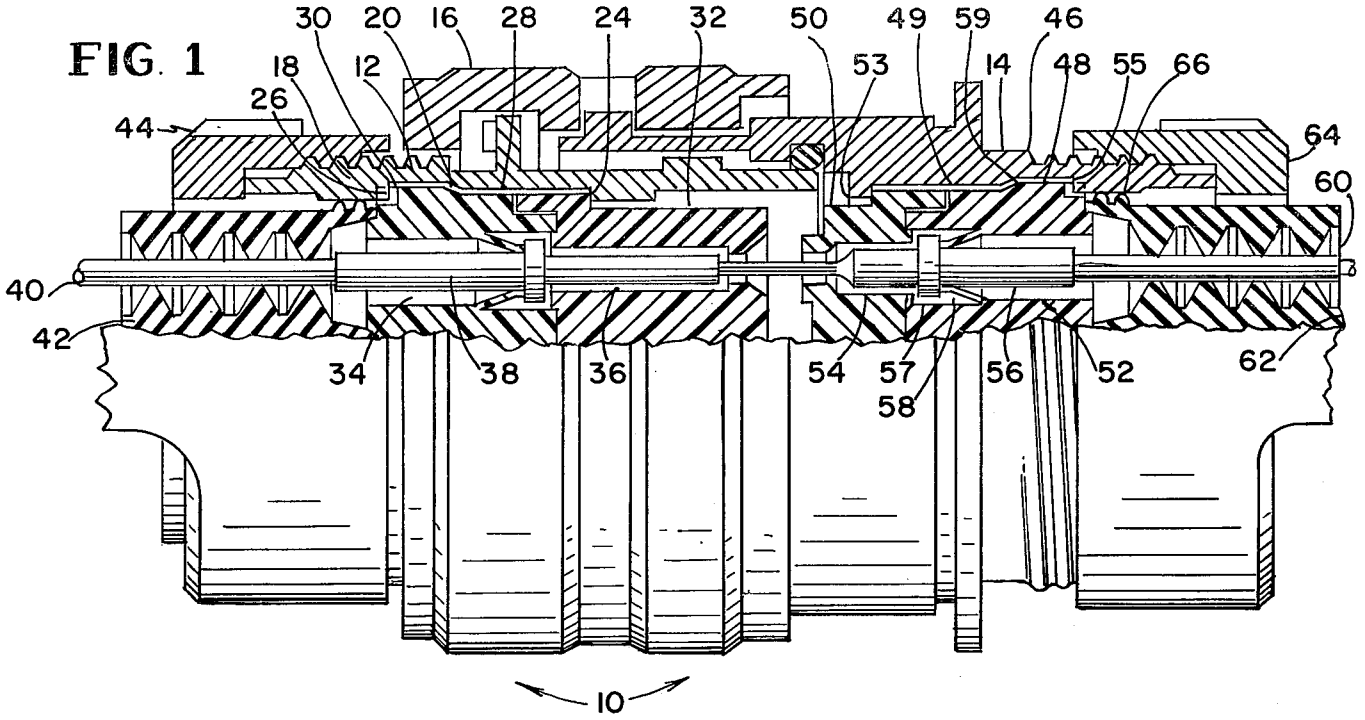
FIG. 1 is a side elevational view partially in section illustrating one embodiment of the invention.
Figure 2:
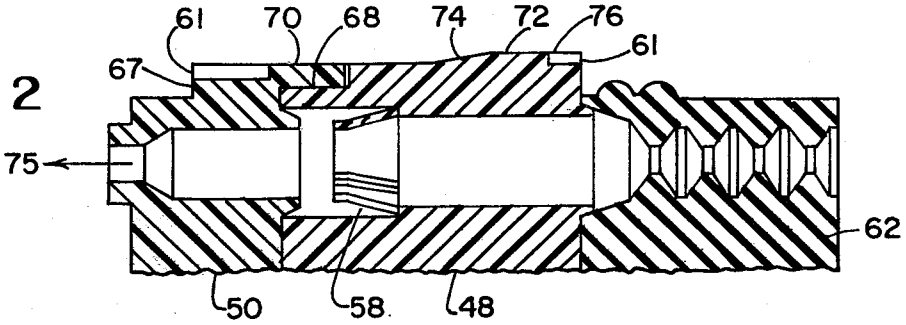
FIG. 2 is a side elevational view partially in section of the insert combination of FIG. 1.
Figures 3, 4, 5, 6, 7, 8:
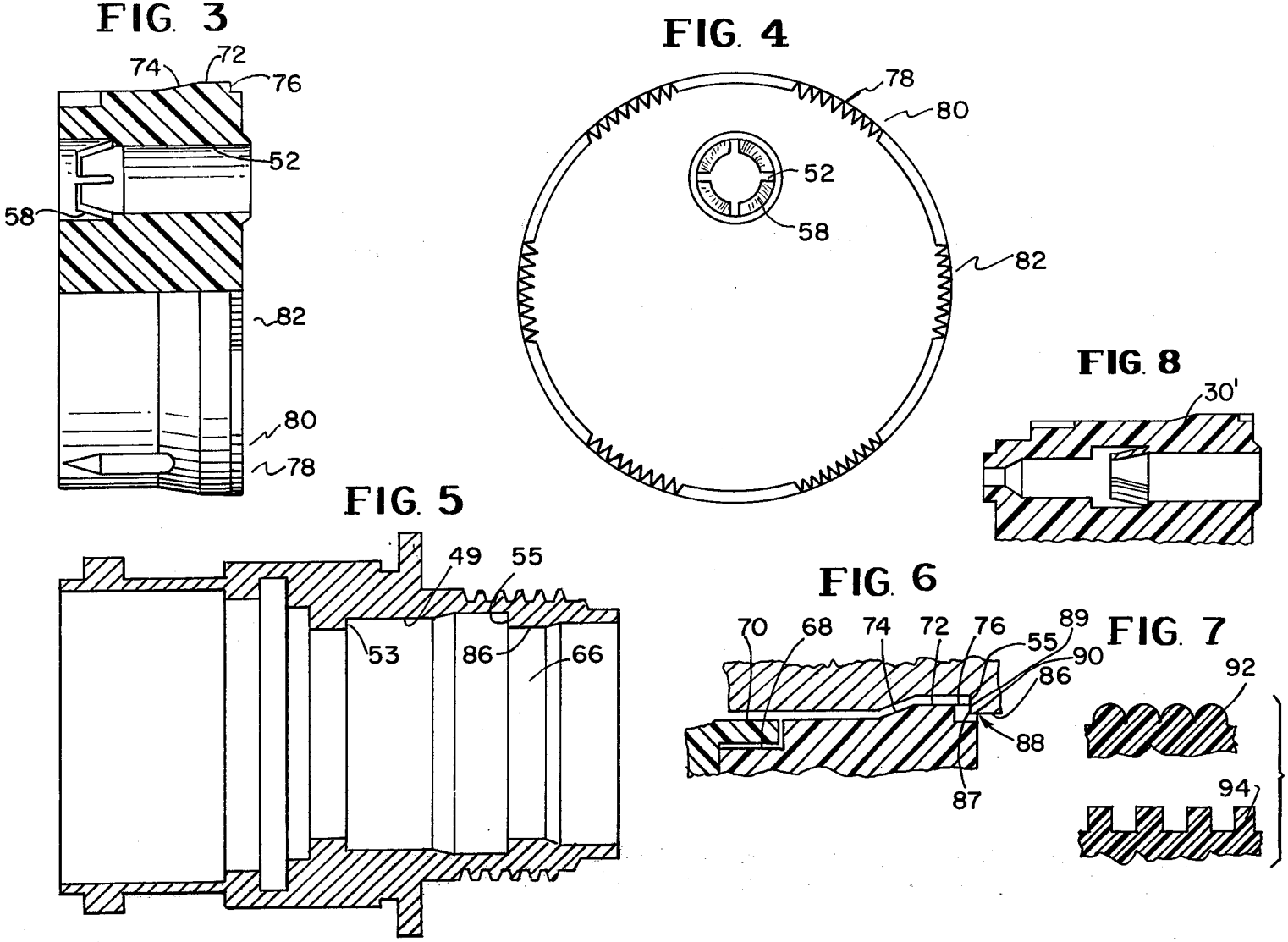
FIG. 3 is a side sectional view of the insert member of FIG. 2.
FIG. 4 is an end view of the insert member of FIG. 3.
FIG. 5 is a side sectional view of a shell member of FIG. 1.
FIG. 6 is a partial view of section A of FIG. 1.
FIG. 7 is a partial view of other forms of the knurled portion of FIG. 4.
FIG. 8 is a side elevational view partially in section of a one-piece insert-retaining member.

Referring to the drawings, FIG. 1 illustrates an electrical connector 10 with receptacle 12 and plug 14 members partially mated and coupled by coupling ring assembly 16 for releasably locking the connector members together by a bayonet latching system. Receptacle 12 includes a housing member represented by shell 18 with an internal cavity 20 extending along a longitudinal axis 22 and provided with insert retention means illustrated by first and second radial shoulders 24 and 26 separated by a predetermined axial distance 28. A plurality of insert members or body members as illustrated by retention disc 30 and front insert 32 are positioned in snug engagement with shoulders 24 and 26 and include axially openings 34 and 36 respectively aligned along axis 22 and in which one or more contact members 38 are positioned and rearwardly connected to conductor 40. Rearwardly positioned in receptacle 12 is a sealing grommet 42 and retention nut 44. In a similar manner, plug 14 includes shell 46 housing retention disc 48 and front end insert 50. Axially aligned openings 52 and 54 are respectively provided in disc 48 and insert 50 for carrying one or more contacts 56. Flanges 57 are provided on contacts 56 which engage retention tines 58 for axial retention of the contacts in the insert. Contacts 56 are rearwardly connected to external circuits by conductors 60 and sealing grommet 62 and retention nut 64 are provided at the rear of the connector member. As illustrated in FIGS. 1 and 2, the insert means includes a plurality of insert members 48 and 50 with each insert member being provided with axially extending sleeve portions 68 and 70 which telescope together with at least one free end portion of a sleeve abutting an opposing shoulder of the other insert member. Passageway 66 provides an entry for mounting the insert in cavity 49 and is defined by inner peripheral wall 86. As illustrated in FIG. 8, the insert-retaining member 30' is of one-piece construction.

In FIGS. 2, 3 and 8 the insert combination and retention disc are illustrated prior to deformation of the insert disc according to the inventive retention technique. Insert disc 48 includes a radially enlarge protected portion illustrated by protective outer annular collar 72 which extends peripherally around disc 48 in a direction transverse to the axis of the insert. Entry ramp 74 is axially disposed to collar 72 in a first or entry direction 75 and facilitates positioning of the insert in the passageway 66 in shell 46. A rear weakened portion 76 disposed axially to collar 72 in an opposite direction extends axially a distance and substantially parallel to the insert axis to provide a plurality of axially extending high points spaced apart transversely to the axis of the insert and extending axially to provide a retention shoulder when deformed. The high points are disposed radially outwardly and inwardly are tapered to provide enlarged bases.

As illustrated in FIGS. 3 and 4, the high points 78 having the form of knurls 80 arranged in a plurality of groups 82 around the periphery of the insert disc 48 as a weakened collar member to provide a plurality of retention surfaces spaced around the periphery of the insert. Other forms of knurl-like portions are illustrated in FIG. 7.

In FIG. 5, shell 46 is illustrated with internal cavity 49 and first and second radial shoulders 53 and 55 separated by a predetermined axial distance 59. Restricted passageway 66 is provided for entry of the inserts to radial shoulder 53 and cavity 49 with wall 86 of the passageway providing an insert compression means for compressing collar 72 during movement in passageway 66 and weakened portion 76 when collar 72 has passed axially into cavity 49. Final positioning of the insert is preferably accomplished by a quick motion in which collar 72 is forced into cavity 49 permitting wall 86 at the junction 87 of wall 86 and shoulder 55 to compress and deform weakened portion 76 to provide a deformed portion 88 as illustrated in FIGS. 1 and 6 for insert retention.

For the desired compression of disc 48, passageway 66 is outwardly dimensioned slightly smaller than protective collar 72 and weakened portion 76 with protective collar having sufficient surface area to withstand the compressive force developed by wall 86 without permanent deformation of the plastic material. Weakened portion 76 is outwardly dimensioned similarly to collar 72 and is formed with a restricted surface area at its outward extremity to be insufficient to withstand the same compressive force so that plastic deformation occurs, i.e. the material is stressed beyond its elastic limit. When collar 72 passes into cavity 49, weakened portion 76 is permanently deformed by wall 86 and junction 87 with radial shoulder 55 to provide a deformed portion 88 with a retention surface illustrated by radial shoulder 89 and axial surface 90 in FIG. 6 for both axial and rotation retention of disc 48. As illustrated in FIG. 6, weakened portion 76 extends axially across radial shoulder 55 and is deformed to confine disc 48 from axial movement in a direction opposite the entry direction. When deformed, weakened portion 76 partially remains positioned in passageway 66 and is held in compressive engagement by wall 86 providing rotational retention of disc 48.

The retention system of the invention is particularly advantageous for use with a shell with retention shoulders 53 and 55 integrally formed in a one-piece housing and with cavity 49 being enlarged substantially over the dimension of passageway 66. The method of fitting one or more plastic insert members in snug retention between first and second opposed radial shoulders 53 and 55 which are separated by an axial distance 59 within an electrical connector housing 46 is advantageously carried out by providing the insert with a retention portion illustrated by shoulder 67 and weakened portion 76 together extending beyond the axial distance separating radial shoulders 53 and 55, providing the housing with deforming means as represented by the wall portion 86 of passageway 66 and the junction 87 of wall portion 86 with radial shoulder 55, axially moving the insert into the housing in a mounting direction 75 to position the insert radial shoulder 67 against the first radial shoulder 53 of the housing, and deforming the weakened portion 76 to provide a second radial surface 89 in engagement with the second radial shoulder 55. Movement of the insert to the cavity is advantageously accomplished by providing a restricted entry passageway 66 leading to shoulder 55 and cavity 49 with wall portion 86 including means for deforming the weakened portion of the insert. Advantageously, the insert is provided with the second portion having a protective portion or collar 72 axially adjacent the weakened portion 76 for protection of the weakened portion until the insert is in a final mounting position.

In the manufacture of one-piece housings and multipiece inserts as illustrated by shell 46 and insert members 48 and 50, respectively, tolerance variations due to manufacture of the parts can cause the axial dimension 59 of the shell to differ from the axial dimension 61 of the retention section of the insert members. The inventive retention system provides for the retention of an insert selected from a group of inserts in which the axial dimension of the insert retention section varies within upper and lower dimensions by providing the insert with a weakened peripheral portion 76 to extend the lower limit beyond the axial distance 59 and providing shell 46 with wall portion 86 and junction 87 of passageway 66 to deform the weakened portion to provide shoulder 89 at essentially the axial distance 59 of the particular shell 46 in which the insert is mounted.

For illustrative purposes and not for limitation, collar 72 is raised above the front entry portion of insert 48 by about 0.010 inches and extends about 0.040 inches axially with the knurled portion extending about 0.020 inches axially and having an outer dimension similar to collar 72. An illustrative diameter of collar 72 is about 0.034 inches with passageway 66 being sized about 0.046 inches. Shells 48 and 46 are preferably metallic such as aluminum and inserts 30, 32, 48 and 50 are formed of a plastic capable of being permanently deformed. A thermoplastic material is preferred such as a polyaromatic sulfone.

We claim:

1. An electrical connector member comprising plastic insert means for carrying at least one contact member and including an end portion with an outer weakened portion, one-piece insert housing means including an axially extending inner cavity housing a section of said insert means, insert retaining means in said housing means snugly retaining said insert from axial movement in said cavity in a mounted position, insert entry means in said housing axially leading to said cavity, insert compression means in said housing means in axial juxtaposition to said cavity for radially compressing and deforming said weakened portion, and said weakened portion including a portion permanently deformed beyond its elastic limit by and at least partially disposed in said insert compression means.

2. The electrical connector member of claim 1 wherein said insert means includes an outer protective portion disposed axially to said weakened portion in an entry direction, said protective portion being capable of withstanding a radial compressive force without permanent deformation which will cause permanent deformation in said weakened portion.

3. The electrical connector member of claim 2 wherein said protective portion includes an outer collar member and said weakened portion includes a plurality of axially extending knurls peripherally arranged transversely to the axis of said insert means.

4. The electrical connector member of claim 3 wherein said insert entry means includes a passageway leading to said cavity.

5. The electrical connector member of claim 4 wherein said compression means includes an annular wall portion within said housing means defining at least a portion of said passageway.

6. The electrical connector member of claim 5 wherein said weakened portion includes a plurality of spaced apart high points arranged peripherally and transversely to the axis of said insert means.

7. An electrical connector member comprising a one-piece housing member including an inner axiallyextending cavity, plastic insert means including a section positioned in said cavity, and a deformable portion, at least one contact member carried by said insert means, means in said housing member for retaining said insert means from axial movement in a first direction, said means including a first surface, deforming means within said housing member for crushing said deformable portion beyond its elastic limit to permanently deform the same and for retaining said insert means from movement in an opposite axial direction, said means including a second surface axially separated from said first surface, and said insert means including a first portion in engagement with said first surface and a second portion with said deformed portion in engagement with said second surface.

8. The connector member of claim 7 wherein said insert means includes a plurality of axially aligned members.

9. The connector member of claim 7 wherein said insert means is integrally formed in a one-piece construction.

10. The connector member of claim 7 wherein said deforming means provides retention of said deformed portion by compressive radial engagement.

11. The connector member of claim 10 wherein said deforming means includes an inward junction of a radial shoulder facing said cavity and said passageway, and said deformed portion of said insert means includes a surface adjoining said shoulder.

12. The connector member of claim 10 wherein said housing member includes an inner passageway extending axially from said cavity for mounting of said insert means, and said deformed portion of said insert means at least partially extends into said passageway.

13. The connector member of claim 12 wherein said second portion of said insert means in said cavity includes an outer peripheral portion substantially parallel to said axis and outwardly dimensioned larger than the outward dimension of said passageway.

14. An electrical connector member comprising a metallic housing including a portion integrally formed in a one-piece construction with an inner axially-extending cavity, and axially opposed and separated first and second opposed radial shoulders, plastic insert means moved axially into said cavity and toward said first shoulder and into snug engagement with said shoulders for confining said insert means from axial movement, said insert means including a portion permanently deformed beyond its elastic limit and gripped by one of said shoulders, and at least one contact member carried by said insert means.

15. The connector member of claim 14 wherein said insert means includes a plurality of axially aligned members.

16. The connector member of claim 14 wherein said housing includes a passageway extending towards said cavity and said second radial shoulder, said insert means including a portion extending at least partially into said passageway.

17. The connector member of claim 16 wherein said insert means includes a radial shoulder in said cavity adjoining said second shoulder.

18. The connector member of claim 17 wherein said portion of said insert means includes a peripheral portion of said deformed portion under compressive engagement with said housing in said passageway and restricting rotational movement of said insert means.

19. The connector member of claim 14 wherein said shoulders are separated by a predetermined distance, said insert means extends axially greater than said distance and includes a deformed portion in engagement with said second shoulder.

20. The connector member of claim 19 including a plurality of said contact members extending axially, insulatively separated and arranged in a predetermined pattern for engagement with contact members in a second connector member.

21. An insert member for axial movement in a first direction into a restricted internal passageway of a housing of an electrical connector member to reach a position axially at least partially beyond and restricted passageway, comprising a body member having a longitudinal axis, a resilient protective outer collar member on said body member dimensioned to be compressed by said housing during axial movement in said passageway and including a peripheral surface area sufficient to withstand said compression without substantial permanent deformation, and a weakened collar member in juxtaposition to said protective collar member in a direction opposite said first direction, said weakened collar member being dimensioned to be compressed in said passageway when said protective collar has passed therethrough and including a peripheral surface area insufficient to withstand said compression without permanent plastic deformation.

22. The insert member of claim 21 including an entry ramp disposed for positioning in said passageway before said peripheral surface area of said protective collar.

23. The insert member of claim 21 wherein said body member includes an entry end portion disposed and dimensioned for entry into said passageway before said protective collar and without encountering significant compression by said housing.

24. The insert member of claim 21 wherein said weakened collar member includes a plurality of axially extending high points with an inwardly increased base.

25. The insert member of claim 24 wherein said high points are arranged in a plurality of peripheral groups for positioning said insert in said housing.

26. The insert member of claim 21, wherein said protective collar member is continuous about the periphery of said body member.

27. The insert member of claim 26, wherein said weakened collar member includes a plurality of radially and axially extending high points each having an inwardly increased base.

28. A method of fitting a plastic insert in snug retention between first and second opposed radial shoulders separated by an axial distance within an electrical connector housing, the insert being selected from a group of inserts having an axial dimension measured from a radial surface to and including an axially separated retention portion and varying within predetermined upper and lower limits, comprising providing said retention portion of said insert with a weakened peripheral portion to extend said lower limit beyond said axial distance, providing said housing with deforming means in close juxtaposition to said second radial shoulder, axially moving said insert into said housing in a mounting direction to position said insert radial shoulder against said first radial shoulder of said housing, and deforming said weakened portion beyond its elastic limit to provide a second radial surface in engagement with said second radial shoulder.

29. The method of claim 28 including the steps of providing said housing with a restricted entry passageway leading to said second shoulder with walls forming said passage including said means for deforming the weakened portion, and providing said second portion with a protective portion adjacent the weakened portion in the mounting direction for protection of said weakened portion until said protective portion passes through said passage and said passage walls deform said weakened portion.

30. The method of claim 28 including the step of providing said weakened portion with a plurality of radially oriented high points extending on an annular periphery and said protective portions with a collar section having sufficient surface area to withstand compression by said passage walls without permanent deformation.

31. An insert member for axial movement in a first direction into a restricted internal passageway of a housing of an electrical connector member to reach a position axially at least partially beyond said restricted passageway, comprising a body member having a longitudinal axis, a resilient protective outer member on said body member dimensioned to be compressed by said housing during axial movement in said passageway and including a peripheral surface area sufficient to withstand said compression without substantial permanent deformation, and a weakened member in juxtaposition to said protective member in a direction opposite said first direction, said weakened member being dimensioned to be compressed in said passageway when said protective collar has passed therethrough and including a peripheral surface area insufficient to withstand said compression without permanent plastic deformation.

* * * * *